US005420623A

United States Patent [19]

Tamura

[11] Patent Number: 5,420,623

[45] Date of Patent: May 30, 1995

[54] RECORDING HEAD HAVING MULTI-LAYER WIRING

[75] Inventor: Hideo Tamura, Kawasaki, Japan

[73] Assignee: Canon Kabushiki Kaisha, Tokyo, Japan

[21] Appl. No.: 101,286

[22] Filed: Aug. 3, 1993

Related U.S. Application Data

[63] Continuation of Ser. No. 825,337, Jan. 27, 1992, abandoned, which is a continuation of Ser. No. 470,586, Jan. 26, 1990, abandoned.

[30] Foreign Application Priority Data

Jan. 27, 1989 [JP] Japan ..... 1-18012

[51] Int. Cl.[6] ..... B41V 2/05

[52] U.S. Cl. ..... 347/58; 174/257; 257/753; 361/779; 437/192

[58] Field of Search ..... 346/140; 257/753, 762, 257/763, 766, 752, 750; 437/192, 189; 174/257; 361/406, 411, 774, 779; 347/58, 57, 59, 50, 64

[56] References Cited

U.S. PATENT DOCUMENTS

| | | | |
|---|---|---|---|
| 3,573,570 | 4/1971 | Fuller | 257/763 |
| 3,922,479 | 11/1975 | Older | 361/414 X |
| 4,189,524 | 2/1980 | Lazzari | 174/257 X |
| 4,386,116 | 5/1983 | Nair | 257/762 X |
| 4,429,321 | 1/1984 | Matsumoto | 347/59 |
| 4,450,457 | 5/1984 | Miyachi et al. . | |
| 4,458,256 | 7/1984 | Shirato et al. | 347/58 |
| 4,463,059 | 7/1984 | Bhattacharya | 257/763 X |
| 4,520,373 | 5/1985 | Ayata et al. | 347/56 |
| 4,567,493 | 1/1986 | Ikeda et al. . | |
| 4,577,202 | 3/1986 | Hara . | |
| 4,594,473 | 6/1986 | Inoue | 174/257 |
| 4,596,994 | 6/1986 | Matsuda et al. . | |
| 4,673,773 | 6/1987 | Nakano | 361/414 X |
| 4,675,693 | 6/1987 | Yano et al. . | |
| 4,686,544 | 8/1987 | Ikeda et al. . | |
| 4,694,306 | 9/1987 | Ikeda et al. . | |
| 4,713,494 | 12/1987 | Oikawa | 174/257 |
| 4,719,477 | 1/1988 | Hess | 347/59 |
| 4,720,716 | 1/1988 | Ikeda et al. . | |
| 4,835,593 | 5/1989 | Arnold | 257/753 X |

FOREIGN PATENT DOCUMENTS 0258606 3/1988 European Pat. Off. .

*Primary Examiner*—Joseph W. Hartary
*Attorney, Agent, or Firm*—Fitzpatrick, Cella, Harper & Scinto

[57] ABSTRACT

An electricity-heat converter is provided on a substrate for a recording head. The recording head generates heat energy for discharging recording liquid by causing the state change of the liquid to occur. A multi-layer wiring is sandwiched between insulating layers comprising an organic material and is connected electrically to the electricity-heat converter through at least one contact portion formed through the insulating layer. The contact portion is provided in a discharging portion of the recording heads.

37 Claims, 5 Drawing Sheets

RECORDING HEAD HAVING MULTI-LAYER WIRING

This application is a continuation of application Ser. No. 07/825,337 filed Jan. 27, 1992, now abandoned, which is a continuation of application Ser. No. 07/470,586 filed Jan. 26, 1990, abandoned.

BACKGROUND OF THE INVENTION

1. Field of the Invention

This invention relates to a recording device such as an output printer of copying device, word processor, facsimile, video, computer, etc. and a substrate for a recording head and a recording head applicable thereto.

More particularly, it relates to a recording head and a recording device to which the liquid jet recording method, which performs recording by discharging liquid for recording through a discharging port, is applicable.

2. Related Background Art

An example of a liquid jet recording head of the prior art is shown in FIGS. 1A and 1B. FIG. 1A is a schematic plan view of the substrate for the recording head. FIG. 1B is a schematic sectional view of the recording head along the line B—B' in FIG. 1A.

The on-demand type recording head of the prior art has an electrode heat converter which generates heat energy to be utilized for discharging liquid (ink) by formation of a heat generating resistance layer 1 comprising $HfB_2$, TaAl, etc. and an electroconductive layer 2 for formation of electrodes comprising Al, etc. arranged at predetermined intervals formed on a substrate 11 comprising a semiconductor such as silicon or an insulating material such as glass, etc., and on the heat generating portion 1*a* of the electricity-heat converter are formed a discharging port and a liquid channel communicated thereto. And, a plurality of discharging ports are provided at a ratio of 8 or more per 1 mm for the purpose of high resolution recording, and electricity-heat converters are arranged at high density so as to correspond thereto.

Here, 3, 4 and 5 are protective layers.

The liquid from a liquid vessel, not shown, is supplied into a common liquid chamber forming a part of liquid channel, and further fills the parts containing the heat-acting portions, etc. corresponding respectively to the discharging ports of the channels with liquid.

Recording by way of liquid jetting generates bubbles by causing the state of change in the liquid on the heat-generating portion 1*a* in the heat acting portion by the heat energy generated from the heat-generating portion 1*a* by applying recording signals on the electrodes, thereby discharging liquid through the pressure of volume expansion of the bubbles to form flying liquid droplets.

The method for preparation of such recording head of the prior art is to be described.

First, an $HfB_2$ film 1 as the heat-generating resistance layer for formation of an electricity-heat converter and Al as the electrode 2 are formed by sputtering, etc. and then subjected to patterning.

Next, $SiO_2$ as the oxidation resistant film 3 for the electricity-heat converter and Ta as the cavitation resistant film 4 are formed by sputtering, etc. and subjected to patterning.

And, a photosensitive polyimide is coated as the ink resistant film 5 and subjected to patterning.

Further, Al, Ni and Cu of the the second layer are subjected to film forming patterning, and Cu is plated to about 10 μm for increasing conductivity to make a common electrode 10. Here, $SiO_2$ represented by the symbol 3 which the layer beneath the common electrode 10 and the photosensitive polyimide represented by the symbol 5 serve as the interlayer insulating layer.

Then, a ceiling plate 14 having a wall portion for sectionalizing the common liquid chamber 12 and individual liquid chambers 13 as the liquid channels for the recording liquid is plastered and a wiring connected to the driving circuit for supplying electrical signals is electrically connected (not shown) to prepare a liquid jet recording head.

However, in the above prior art example, since the common electrode 10 exists externally of the ceiling plate 14 (namely outside the liquid channel of the recording head), the length of the electrode 2 on the common electrode side is required to be $l_2$ as shown in FIG. 1A, whereby a considerable length of high density wiring is required at the electrode. For this reason, other than the shortcomings in production such as lowered yield caused by short circuit, wire breaking, etc., short circuit or wire wiring sometimes occurred similarly when driving is performed by passing great currents, whereby durability of the recording head was lowered.

SUMMARY OF THE INVENTION

The present invention has been accomplished in view of the technical task as described above.

An object of the present invention is to provide a recording head improved in durability, which can obtain high resolution and has a consistantly good discharging state.

Another object of the present invention is to provide a recording head which can improve the yield in production, is small in size and is inexpensive.

Still another object of the present invention is to provide a substrate for a recording head, comprising an electricity-heat converter capable of generating heat energy for discharging liquid by causing the state change of liquid for recording by heat to occur and a wiring which is sandwiched on both sides between insulating layers comprising an organic material and connected electrically to the electricity-heat converter through at least one contact portion formed at the insulating layer.

Still another object of the present invention is to provide a recording head, comprising:

- a liquid discharging portion having a discharging port for discharging liquid; and
- a substrate having an electricity-heat converter capable of generating heat energy for discharging liquid by causing the state change of liquid for .recording by heat to occur existing within said liquid discharging portion and a wiring which is sandwiched on both sides between insulating layers comprising an organic material and connected electrically to said electricity-heat converter through at least one contact portion formed at said insulating layer.

Still another object of the present invention is to provide a recording device, comprising:

- a liquid discharging portion having a discharging port for discharging liquid;
- a recording means including a substrate having an electricity-heat converter capable of generating heat energy for discharging liquid by causing the state change of liquid for recording by heat to occur existing within said liquid discharging portion, and a wiring which is sandwiched on both sides between insulating layers comprising an organic material and connected electrically to said electricity-heat converter through at least one contact portion formed at said insulating layer;

a signal supplying means for supplying recording signals to said electricity-heat converter; and a conveying means for conveying recording medium.

Still another object of the present invention is to enable placement of a wiring connected to the common electrode with greater thickness and/or width than electrode into the (common) liquid chamber b use of organic materials above and beneath the electroconductive layers as a part of the wiring portion electrical connected to the electrodes, whereby the length of the common electrode can be made shorter to great extent. Accordingly, the electrodes can be made shorter, whereby generation of short circuit and wire breaking can be extremely reduced.

Also, it becomes very easy to provide the common wiring in the liquid chamber, whereby higher densification and miniaturization of the recording head are rendered possible.

DETAILED DESCRIPTION OF THE PREFERRED EMBODIMENTS

Figure 1A:
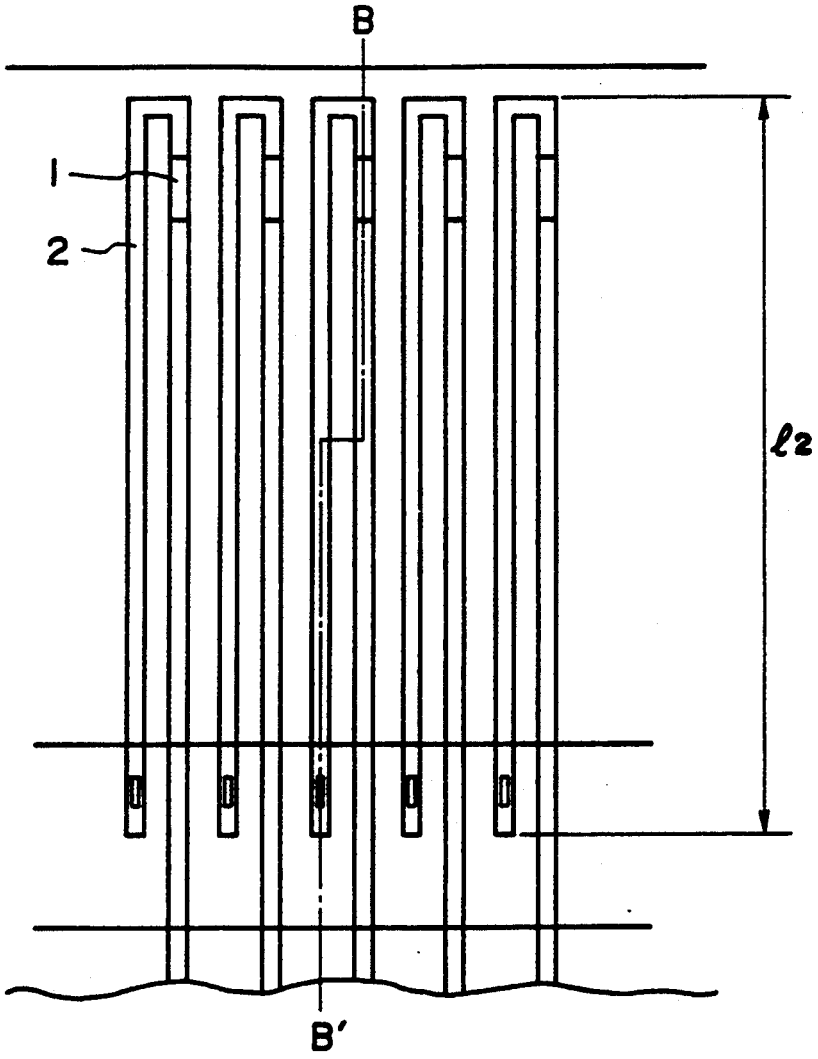
FIG. 1A PRIOR ART
FIG. 1A is a schematic plan view showing the recording head substrate of a prior art example.
Figure 1B:
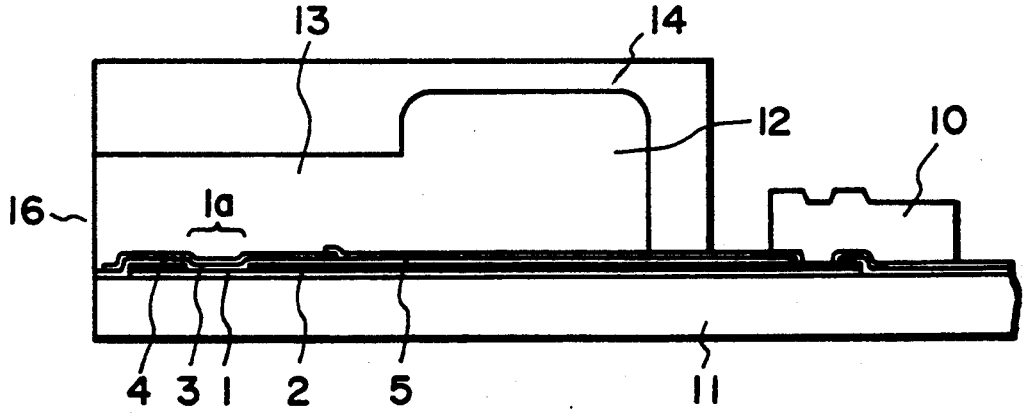
FIG. 1B PRIOR ART
FIG. 1B is a schematic sectional view of the recording head along the line B—B' in FIG. 1A.

Referring now to the drawings, the embodiments of the present invention are to be described, but the present invention is not limited to the following embodiments, but may be any constitution which can accomplish the object of the present invention.

Figure 2:
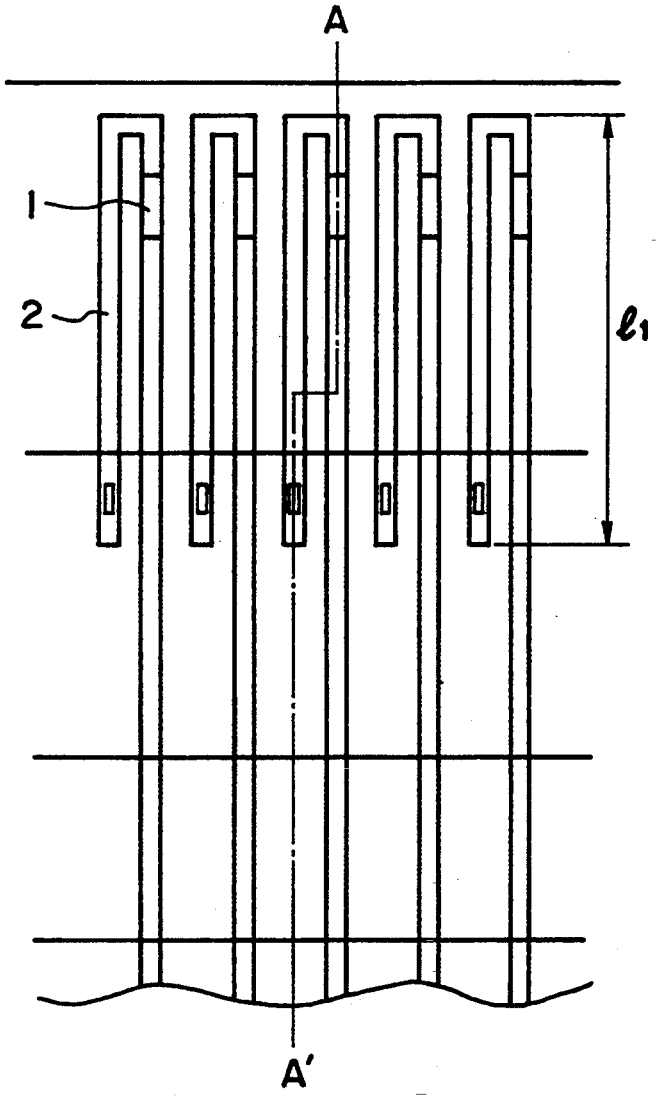
FIG. 2 is a schematic plan view showing the recording head according to the present invention.
Figure 3:
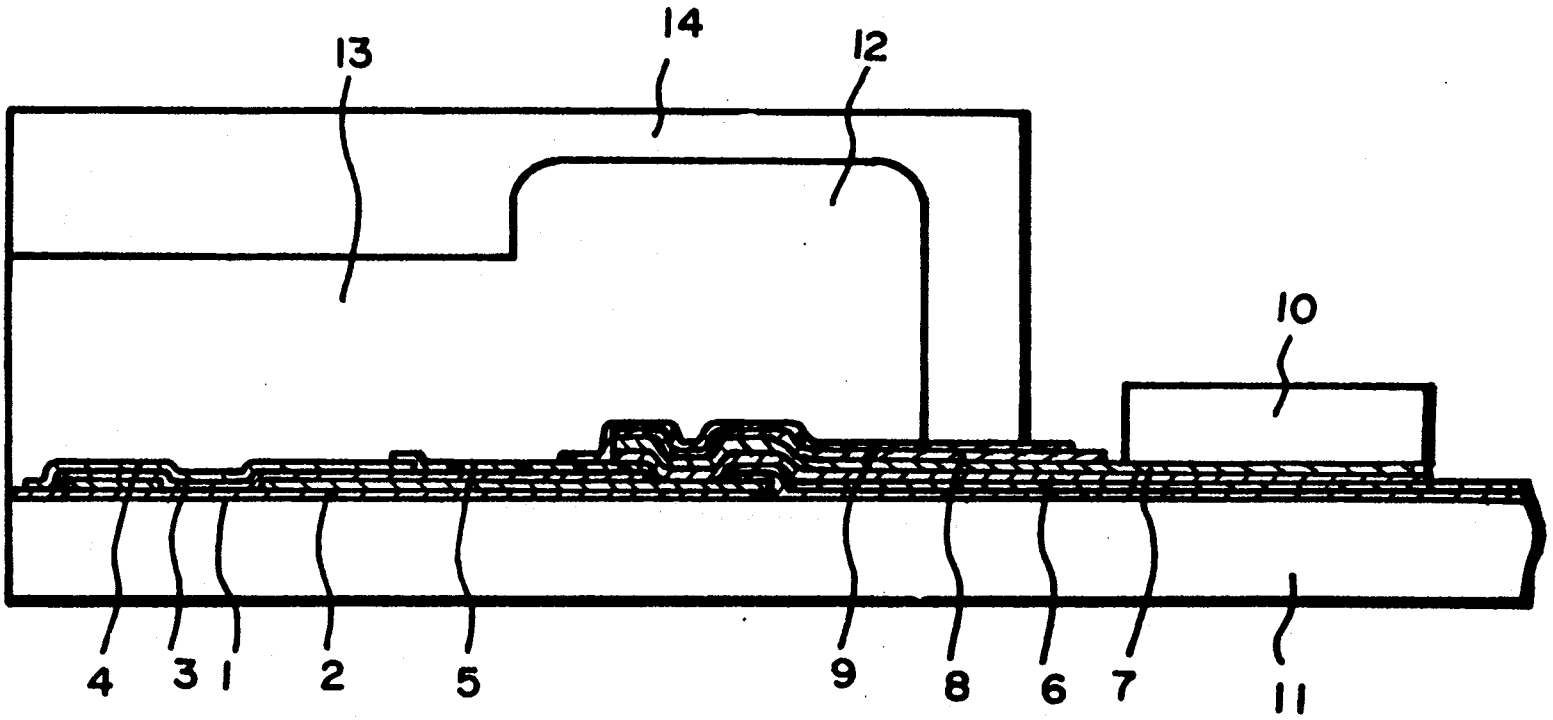
FIG. 3 is a schematic sectional view of the recording head along the line A—A' in FIG. 2.

FIG. 2 is a schematic plan view of the substrate of the recording head according to the present invention, and FIG. 3 is a schematic sectional view of the recording head along the line A—A' in FIG. 2.

First, on the substrate 11 are provided a $HfB_2$ layer as the heat generating layer 1 and an Al layer as the electrode 2 of the electricity-heat converter for forming an electricity-heat member, and a first layer wiring is formed. An $SiO_2$ layer as the oxidation resistant protective film 3 of the electricity-heat converter and a Ta layer as the cavitation resistant protective film 4 are formed. As the ink resistant protective film 5, a photosensitive polyimide 5 is coated. A part of the wiring portion as the second electroconductive wiring consists of multiple layers with different materials, and the lower layer 6 as the second elecroconductive layer 6 and the lowest layer 8 comprise the same material so as to sandwich the first electroconductive layer 7 above and beneath thereof. Here, 6 is Ti layer, 7 Cu layer and 8 Ti layer.

On the above second layer wirings (6, 7, 8), as the protective layer 9 comprising an organic material, is coated a photosensitive polyimide. For formation of plated electrodes by etching of Ti of the second electroconductive layer, Cu is exposed and Cu of higher conductivity is formed as the external common electrode 10.

The respective layer constitutions are described in detail.

They can be easily understood by referring to the enlarged portion in FIG. 3.

The heat generating resistance layer 1 and the electrode 2 are terminated respectively within the liquid chamber 12, and a $SiO_2$ layer 3 and a photosensitive polyimide 5 are arranged thereon. Here, after formation of the first opening by patterning of the $SiO_2$ layer 3, the polyimide 5 is formed and the second opening with smaller size than the first opening is formed by patterning. By doing so, the $SiO_2$ is covered at the end portion with the thru-hole portion. Through the thru-hole, Ti layer 6, Cu layer 7 and Ti layer 8 are successively formed, patterned and finally the photosensitive polyimide 9 is formed so as to cover over these to constitute a connecting portion.

Figure 4:
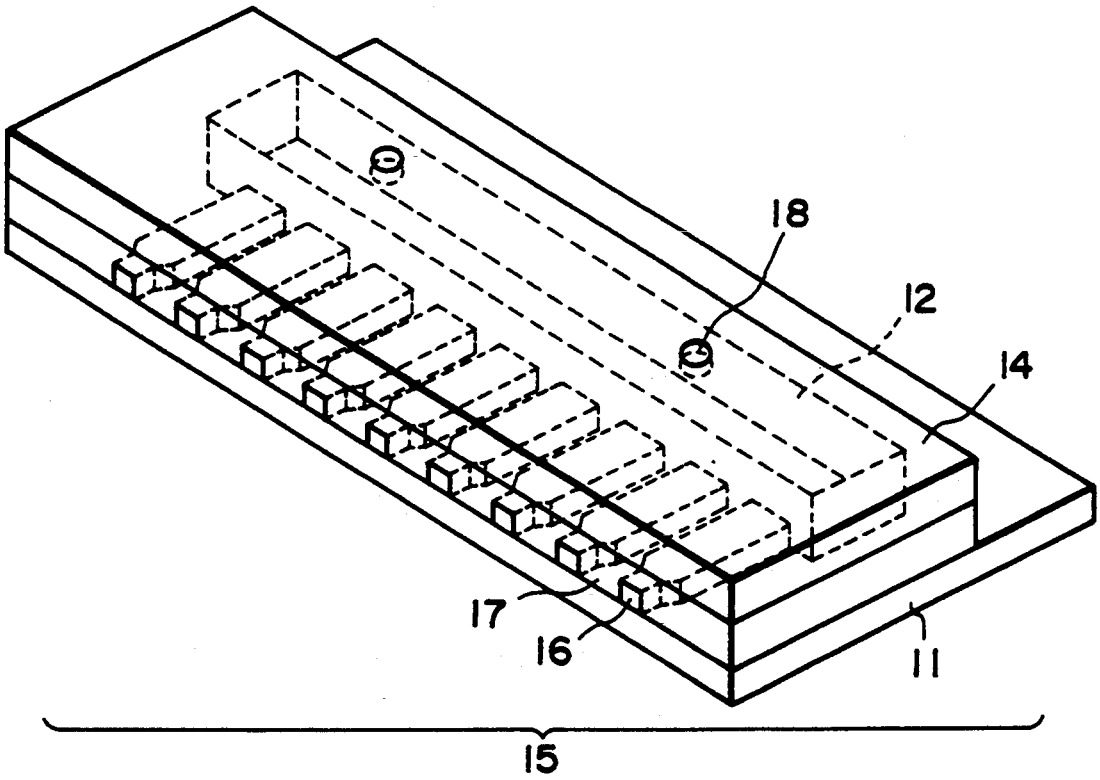
FIG. 4 PRIOR ART
FIG. 4 is a schematic perspective view of a conventional recording head construction that can incorporate the present invention.

A ceiling plate 14 is plastered having the grooves for the common liquid chamber 12 and the individual liquid channels 13 formed thereon on the substrate, and the wiring for connection to the main device side is electrically connected to constitute the liquid jet recording head 15 (FIG. 4). Numeral 16 is discharging port, 17 is liquid channel wall, and 18 is a port for supplying recording liquid.

Here, Ti, Cu and Ti forming the second layer wiring have respectively the following functions.

Ti which constitutes the lowest layer 6 as the second electroconductive layer has good adhesion to the photosensitive polyimide which constitutes the ink resistant protective film 5. Here, other than Ti, Cr, etc. may be used.

Cu which constituted the intermediate layer 7 as the first electroconductive layer enhances the conductivity of the second layer wiring, serving as the plating subbing layer during preparation of the external common electrode 10, and here, other than Cu, Ni, Au, Sn, etc. may be suitably available.

Also, Ti, which constitutes the uppermost layer 8 which is the second electroconductive layer, has good adhesion to the photosensitive polyimide constituting the protective film 9 of the second layer wiring, and also at the same time functions as the oxidation resistant protective film for preventing oxidation of Cu which is one of the constituent materials during thermal curing in the preparation steps of the photosensitive polyimide. Also here, other than Ti, Cr, etc. may be preferably available.

Figure 5:
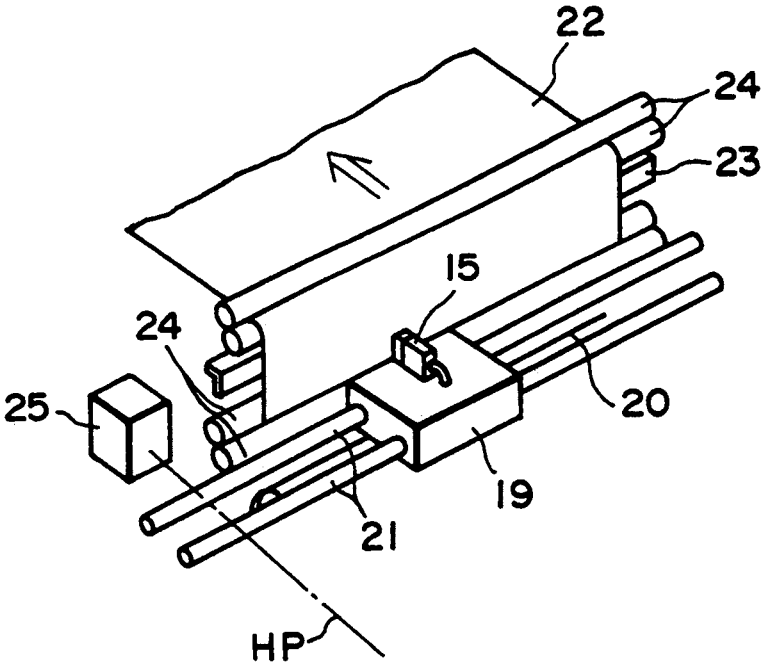
FIG. 5 PRIOR ART
FIG. 5 is a schematic illustration of a conventional liquid jet recording device construction that can incorporate the present invention.

The liquid recording head 15 as described above is mounted on the carriage 19 as shown in FIG. 5, to be used for the liquid jet recording device. The recording head is scanned along the shafts 21 by means of the wire 20 for transmitting the driving force. The recording paper 22 as the recording medium is conveyed by the paper delivery roller 24 in contact with the conveying means, namely the platen 23. Numeral 25 is a discharging restoration system.

Figure 6:
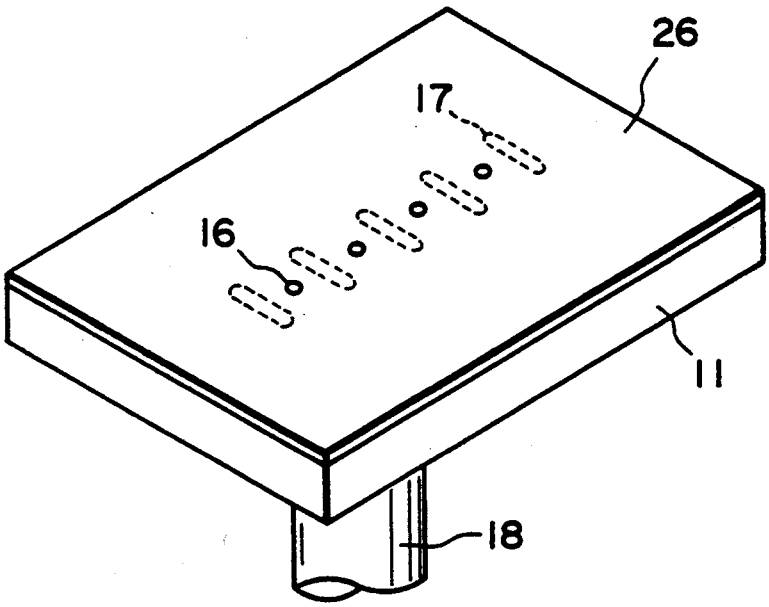
FIG. 6 PRIOR ART
FIG. 6 is a schematic perspective view of a conventional recording head construction that can incorporate another embodiment of the present invention.

Other than the recording heads which perform discharging in substantial the horizontal direction relative to the heat generating surface of the electricity-heat converter as shown in FIG. 4, the present invention is also applicable to the type which performs discharging in the direction crossing with the heat-generating surface as shown in FIG. 6.

This comprises an orifice plate 26 having a discharging orifice 16 and a liquid channel wall 17 in combination on a heater substrate 11, and 18 shows the supplying inlet of recording liquid.

As described above, the recording head of the present invention can accomplish miniaturization, higher densification, and therefore can be used suitably for the type which is provided integrally with a liquid vessel and made detachable relative to the carriage.

Of course, since higher densification of the electricity-heat converter can be accomplished under high reliability, the present invention can be preferably applied to the full-line type wherein some hundred to some thousand electricity-heat converters are arranged at a high density of 8 or more per 1 mm, whereby cost decrease to a great extent can be expected.

As described above, by making a structure using layers of organic materials above and beneath the electroconductive layer, the common electrode wiring can be placed into the (common) liqid chamber, and the length of the electrodes wired at higher density can be made shorter, whereby the generation ratios of short circuit and wire breaking can be extremely reduced to further improve the yield.

I claim:

1. A recording head substrate, comprising:

a plurality of electricity-heat converter elements for generating heat for discharging an ink liquid by causing a change of a state of the ink liquid, each said electricity-heat converter element including a resistive portion, a first electrode and a second electrode, said electrodes leading from said resistive portion; and an electrode wiring located between an upper layer and a lower layer of an electrically insulative ink resistant material, said lower layer having a plurality of through-holes, which said electrode wiring is connected to each said first electrode via an associated said through-hole, wherein said electrode wiring consists of layers of electro-conductive material, which layers are located between said upper and said lower layers, and which extend over each said through hole and which are connected to each said first electrode, and said through hole is arranged at a position corresponding to a liquid chamber.

2. A recording head substrate as in claim 1, wherein said electrode wiring comprises:

a first layer of a first electroconductive material; and at least two second layers of a second electroconductive material, wherein said first layer is sandwiched between said second layers of said second electroconductive material.

3. A recording head substrate as in claim 2, wherein said second electroconductive material exhibits a better adhesion to said electrically insulative ink resistant material than does said first electroconductive material.

4. A recording head substrate as in claim 2, wherein said first electroconductive material has a lower electrical resistivity than does said second electroconductive material.

5. A recording head substrate as in claim 2, wherein said second electroconductive material comprises at least one of titanium and chromium.

6. A recording head substrate as in claim 2 or claim 5, wherein said first electroconductive material comprises at least one of copper, nickel, gold, and tin.

7. A recording head substrate as in claim 1, wherein said electrically insulative ink resistant material comprises an organic material.

8. A recording head substrate as in claim 7, wherein said organic material comprises polyimide.

9. A recording head substrate as in claim 1, wherein said electrically insulative ink resistant material comprises a light sensitive material.

10. A recording head substrate as in claim 1, wherein said electrode wiring has a layer thickness which is greater than a thickness of the first and the second electrodes of each said electricity-heat converter.

11. A recording head substrate as in claim 1, wherein said electricity-heat converters are provided at a density of at least eight per millimeter.

12. A recording head comprising:

a liquid discharge port for discharging liquid;

a liquid passage continuous with said discharge port;

a liquid chamber for supplying an ink liquid to said liquid passage; and a recording head substrate comprising;

a plurality of electricity-heat converter elements for generating heat for discharging an ink liquid by causing a change of a state of the ink liquid, each said electricity-heat converter element including a resistive portion, a first electrode and a second electrode, said electrodes leading from said resistive portion, and an electrode wiring located between an upper layer and a lower layer of an electrically insulative ink resistant material, said lower layer having a plurality of through-holes, which said electrode wiring is connected to each said first electrode via an associated said through-hole, wherein said electrode wiring consists of layers of electro-conductive material, which layers are located between said upper and said lower layers, and which extend over each said through hole and which are connected to each said first electrode, and said through hole is arranged at a position corresponding to said liquid chamber.

13. A recording head as in claim 12, wherein said electrode wiring comprises:

a first layer of a first electroconductive material; and at least two second layers of a second electroconductive material, wherein said first layer is sandwiched between said second layers of said second electroconductive material.

14. A recording head as in claim 13, wherein said second electroconductive material exhibits a better adhesion to said electrically insulative ink resistant material than does said first electroconductive material.

15. A recording head as in claim 13, wherein said first electroconductive material has a lower electrical resistivity than does said second electroconductive material.

16. A recording head as in claim 13, wherein said second electroconductive material comprises at least one of titanium and chromium.

17. A recording head as in claim 13 or claim 16, wherein said first electroconductive material comprises at least one of copper, nickel, gold, and tin.

18. A recording head as in claim 12, wherein said electrically insulative ink resistant material comprises an organic material.

19. A recording head as in claim 18, wherein said organic material comprises polyimide.

20. A recording head as in claim 12, wherein said electrically insulative ink resistant material comprises a light sensitive material.

21. A recording head as in claim 12, wherein said electrode wiring has a layer thickness which is greater than a thickness of the first and the second electrodes of each said electricity-heat converter.

22. A substrate as in claim 12, wherein said electricity-heat converters are provided at a density of at least eight per millimeter.

23. A recording head as in claim 12, wherein said recording head is a full line type.

24. A recording head as in claim 12, further comprising an integrally-formed liquid vessel.

25. A recording device comprising:

a liquid discharge port for discharging liquid;

a liquid passage continuous with said discharge port;

a liquid chamber for supplying an ink liquid to said liquid passage; and a recording means for recording, comprising a substrate comprising;

a plurality of electricity-heat converter elements for generating heat for discharging an ink liquid by causing a change of a state of the ink liquid, each said electricity-heat converter element including a resistive portion, a first electrode and a second electrode, said electrodes leading from said resistive portion, and an electrode wiring located between an upper layer and a lower layer of an electrically insulative ink resistant material, said lower layer having a plurality of through-holes, which said electrode wiring is connected to each said first electrode via an associated said through-hole defined, wherein said electrode wiring consists of layers of electro-conductive material, which layers are located between said upper and said lower layers, and which extend over each said through hole and which are connected to each said first electrode, and said through hole is arranged at a position corresponding to said liquid chamber;

signal supplying means for supplying a plurality of recording signals to said electricity-heat converters; and conveying means for conveying a recording medium.

26. A recording device as in claim 25, wherein said electrode wiring comprises:

a first layer of a first electroconductive material; and at least two layers of a second electroconductive material, wherein said first layer is sandwiched between said second layers of said second electroconductive material.

27. A recording device as in claim 26, wherein said second electroconductive material exhibits a better adhesion to said electrically insulative ink resistant material than does said first electroconductive material.

28. A recording device as in claim 26, wherein said first electroconductive material has a lower electrical resistivity than does said second electroconductive material.

29. A recording device as in claim 26, wherein said second electroconductive material comprises at least one of titanium and chromium.

30. A recording device as in claim 26 or claim 29, wherein said first electroconductive material comprises at least one of copper, nickel, gold, and tin.

31. A recording device as in claim 25, wherein said electrically insulative ink resistant material comprises an organic material.

32. A recording device as in claim 31, wherein said organic material comprises polyimide.

33. A recording device as in claim 25, wherein said electrically insulative ink resistant material comprises a light sensitive material.

34. A recording device as in claim 25, wherein said electrode wiring has a layer thickness which is greater than a thickness of the first and the second electrodes of each said electricity-heat converter.

35. A substrate as in claim 25, wherein said electricity-heat converters are provided at a density of at least eight per millimeter.

36. A recording head as in claim 25, wherein said recording head is a full line type.

37. A recording head as in claim 25, further comprising an integrally-formed liquid vessel.

* * * * *

UNITED STATES PATENT AND TRADEMARK OFFICE

CERTIFICATE OF CORRECTION

PATENT NO. : 5,420,623

DATED : May 30, 1995

INVENTOR(S) : HIDEO TAMURA

It is certified that error appears in the above-identified patent and that said Letters Patent is hereby corrected as shown below:

COLUMN 1

Line 48, "channels with liquid." should read --liquid channels.--.

COLUMN 2

Line 54, ".recording" should read --recording--.

COLUMN 3

Line 13, "b" should read --by--.
Line 15, "electrical" should read --electrically--.
Line 68, "lowest" should read --upper--.

COLUMN 4

Line 48, "available." should read --used.--.
Line 59, "available." should read --used.--.

UNITED STATES PATENT AND TRADEMARK OFFICE

CERTIFICATE OF CORRECTION

PATENT NO. : 5,420,623

DATED : May 30, 1995

INVENTOR(S) : HIDEO TAMURA

It is certified that error appears in the above-identified patent and that said Letters Patent is hereby corrected as shown below:

COLUMN 5

Line 2, "substantial" should read --substantially--.
Line 27, "liqid" should read --liquid--.

Signed and Sealed this

Thirty-first Day of October 1995

*Attest:*

*Attesting Officer*

BRUCE LEHMAN

*Commissioner of Patents and Trademarks*